US007758387B2

(12) United States Patent
Yu et al.

(10) Patent No.: US 7,758,387 B2
(45) Date of Patent: Jul. 20, 2010

(54) ELECTRICAL CARD CONNECTOR WITH IMPROVED CARD RESTRICTION STRUCTURE

(75) Inventors: Jian-Fei Yu, Kunshan (CN); Qi-Jun Zhao, Kunshan (CN); Hua Yin, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 32 days.

(21) Appl. No.: 12/316,267

(22) Filed: Dec. 11, 2008

(65) Prior Publication Data

US 2009/0149071 A1 Jun. 11, 2009

(30) Foreign Application Priority Data

Dec. 11, 2007 (CN) ..... 2007 2 0131353 U

(51) Int. Cl.
*H01R 24/00* (2006.01)

(52) U.S. Cl. ..... 439/631; 439/633

(58) Field of Classification Search ..... 439/64, 439/101, 108, 377, 630–635, 924.1
See application file for complete search history.

(56) References Cited

U.S. PATENT DOCUMENTS

| | | | | |
|---|---|---|---|---|
| 6,976,879 | B2 | 12/2005 | Shishikura et al. | |
| 7,083,440 | B2 * | 8/2006 | Shen et al. | 439/138 |
| 7,112,095 | B2 * | 9/2006 | Shen et al. | 439/630 |
| 6,913,492 | B2 | 1/2007 | Kuroda et al. | |
| 7,204,718 | B2 * | 4/2007 | Lai | 439/630 |
| 7,377,814 | B2 * | 5/2008 | Shen et al. | 439/630 |
| 7,377,816 | B1 * | 5/2008 | Lin | 439/630 |

FOREIGN PATENT DOCUMENTS

| | | |
|---|---|---|
| CN | 2757370 Y | 2/2006 |
| CN | 2857266 Y | 1/2007 |

* cited by examiner

*Primary Examiner*—Thanh-Tam T Le
(74) *Attorney, Agent, or Firm*—Wei Te Chung; Andrew C. Cheng; Ming Chieh Chang

(57) ABSTRACT

An electrical card connector for insertion of a first card and a second card which is wider than the first card, includes an insulative housing defining a front mating port, a card receiving space extending backwardly from the mating port for receiving the first and the second cards, and a plurality of terminals for mating with a first card and a second card wider than the first card. A card restriction mechanism is fixed to the insulative housing and includes a guiding body and an elastic spring located on the guiding body. The guiding body restricts and guides the first card and second cards to be inserted into the receiving space while the cards moving through the mating port.

9 Claims, 10 Drawing Sheets

4

ELECTRICAL CARD CONNECTOR WITH IMPROVED CARD RESTRICTION STRUCTURE

BACKGROUND OF THE INVENTION

1. Field of the Invention

The present invention relates to an electrical card connector, more particularly to an electrical card connector with improved card restriction structure for restricting and guiding insertion of corresponding cards with different width.

2. Description of Related Art

Nowadays, memory cards are widely used in electronic devices. Electrical card connectors are usually mounted on a PCB of the electronic devices to establish data transmission between the memory cards and the electronic devices. Chinese Patent Issued Number 2757370Y discloses an electrical card connector for insertion of a first card and a second card which is wider than the first card. The electrical card connector includes an insulative housing with a card receiving space, a guiding body located on two opposite sides of the receiving space, and a spring secured on the insulative housing for abutting against the guiding body rotating in a vertical direction. The card receiving space includes a first receiving space for receiving the first card and a second receiving space for receiving the second card. The guiding body defines a first front guiding surface for guiding the cards in the vertical direction, a second inclined guiding surface and a third inclined guiding surface extending from the first guiding surface upwardly. Both of the second guiding surface and the third guiding surface are offset behind the first guiding surface. The cards need to be guided by the second guiding surface and the third guiding surface after the first guiding surface. The second guiding surface is located at an inner side of the third surface. If the first card is inserted shiftly, the first card would be inserted into the second receiving space but not the first receiving space and guided by the third guiding surface after the first guiding surface. As a results, signal transmission is terribly affected between the first card and the electrical card connector.

Hence, an improved electrical card connector with improved card restriction structure is needed to solve the problem above.

BRIEF SUMMARY OF THE INVENTION

An electrical card connector for insertion of a first card and a second card which is wider than the first card, includes an insulative housing and a plurality of terminals receiving into the insulative housing. The insulative housing define a front mating port and a card receiving space extending from the mating port for receiving the first and the second cards. The insulative housing further includes a base and a pair of side portions extending forwardly from lateral sides of the base. The receiving space is disposed between the pair of side portions. Each terminals includes a contact portion extending into the receiving space for mating with the first and the second cards and a soldering tail extending out of the insulative housing. A pair of card restriction mechanisms is fixed to the insulative housing adjacent to one side portion. The card restriction mechanism includes a guiding body extending into the receiving space and an elastic spring located on the guiding body for abutting against the guiding body towards the mating port in order to restrict and guide the first and the second cards in the mating port. As a result, both of the first and the second cards can be restricted in the mating port.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENT

In the following description, numerous specific details are set forth to provide a thorough understanding of the present invention. However, it will be obvious to those skilled in the art that the present invention may be practiced without such specific details. In other instances, well-known circuits have been shown in block diagram form in order not to obscure the present invention in unnecessary detail. For the most part, details concerning timing considerations and the like have been omitted inasmuch as such details are not necessary to obtain a complete understanding of the present invention and are within the skills of persons of ordinary skill in the relevant art.

Figure 1:
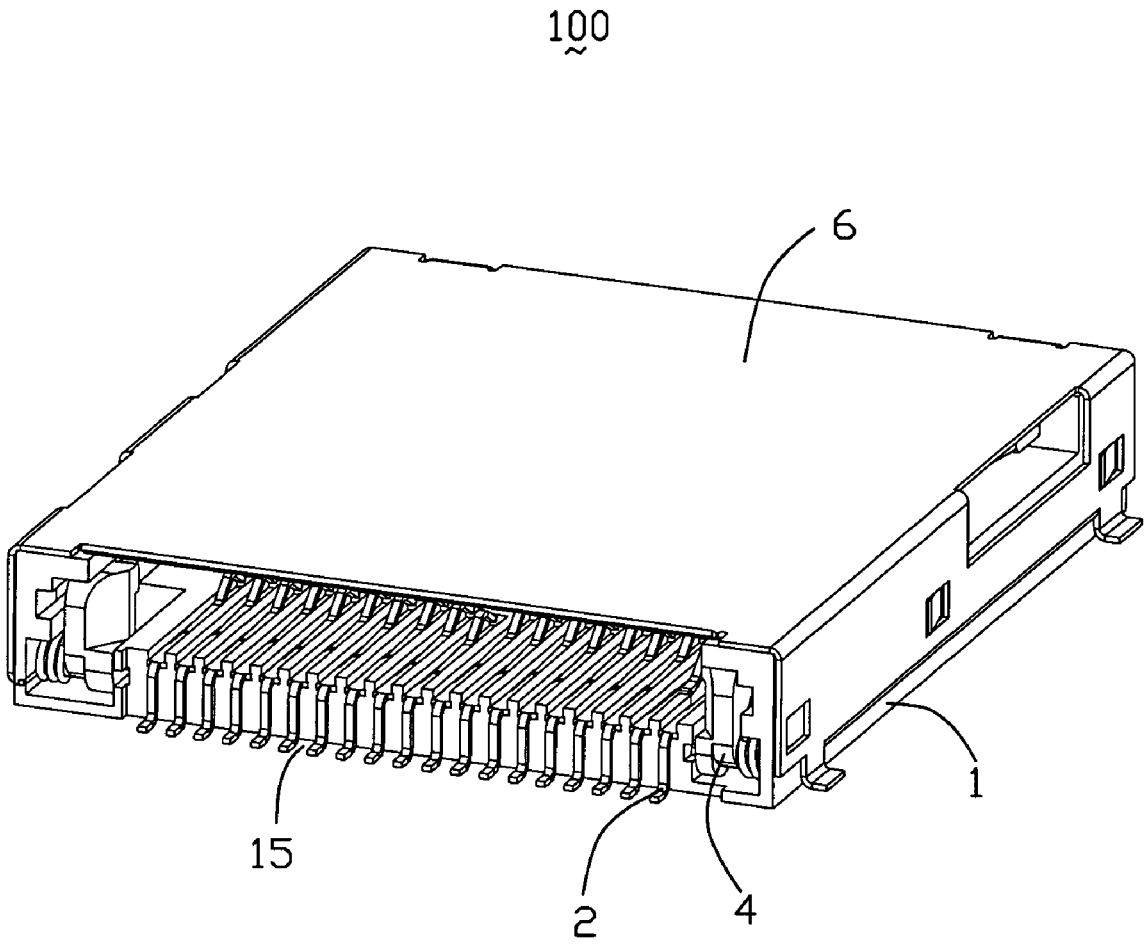
FIG. 1 is a perspective view of an electrical card connector according to the present invention.
Figure 2:
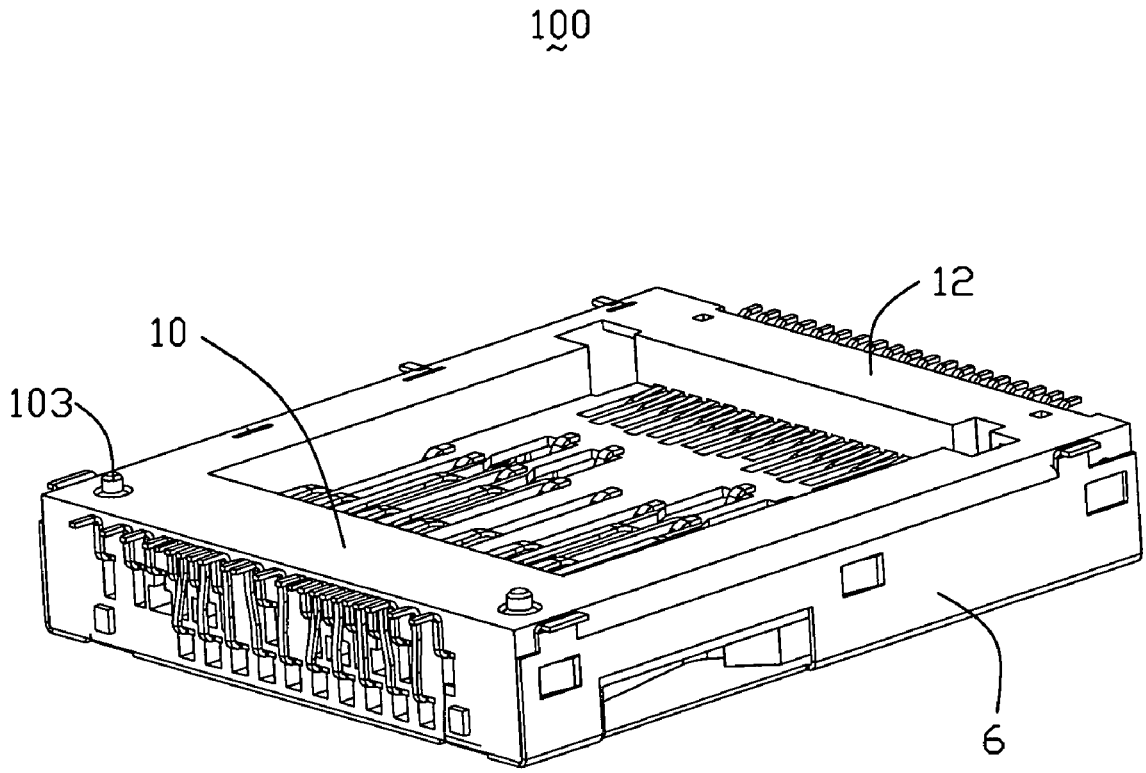
FIG. 2 is another perspective view of the electrical card connector.
Figure 3:
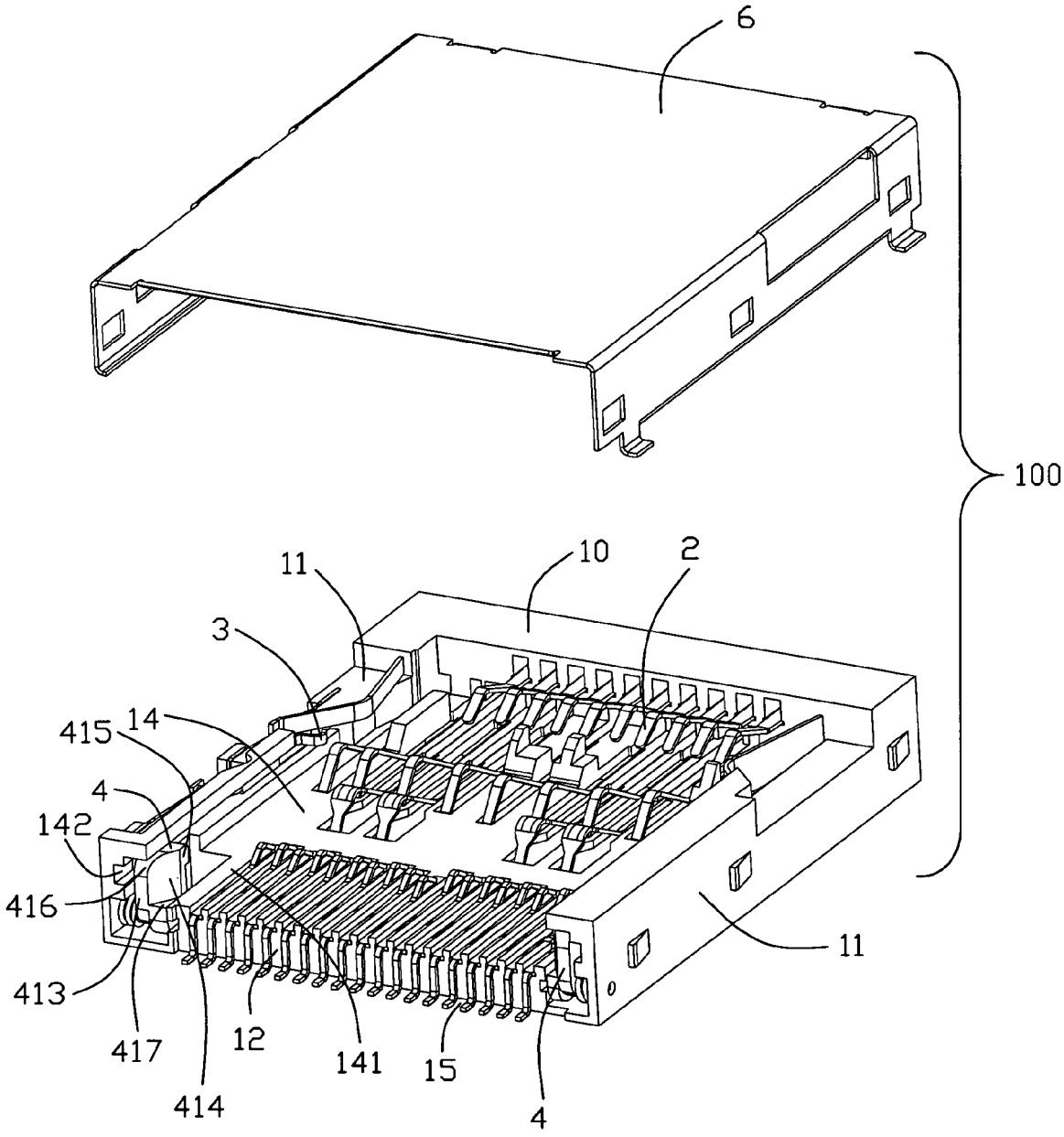
FIG. 3 is a partly exploded view of the electrical card connector.
Figure 4:
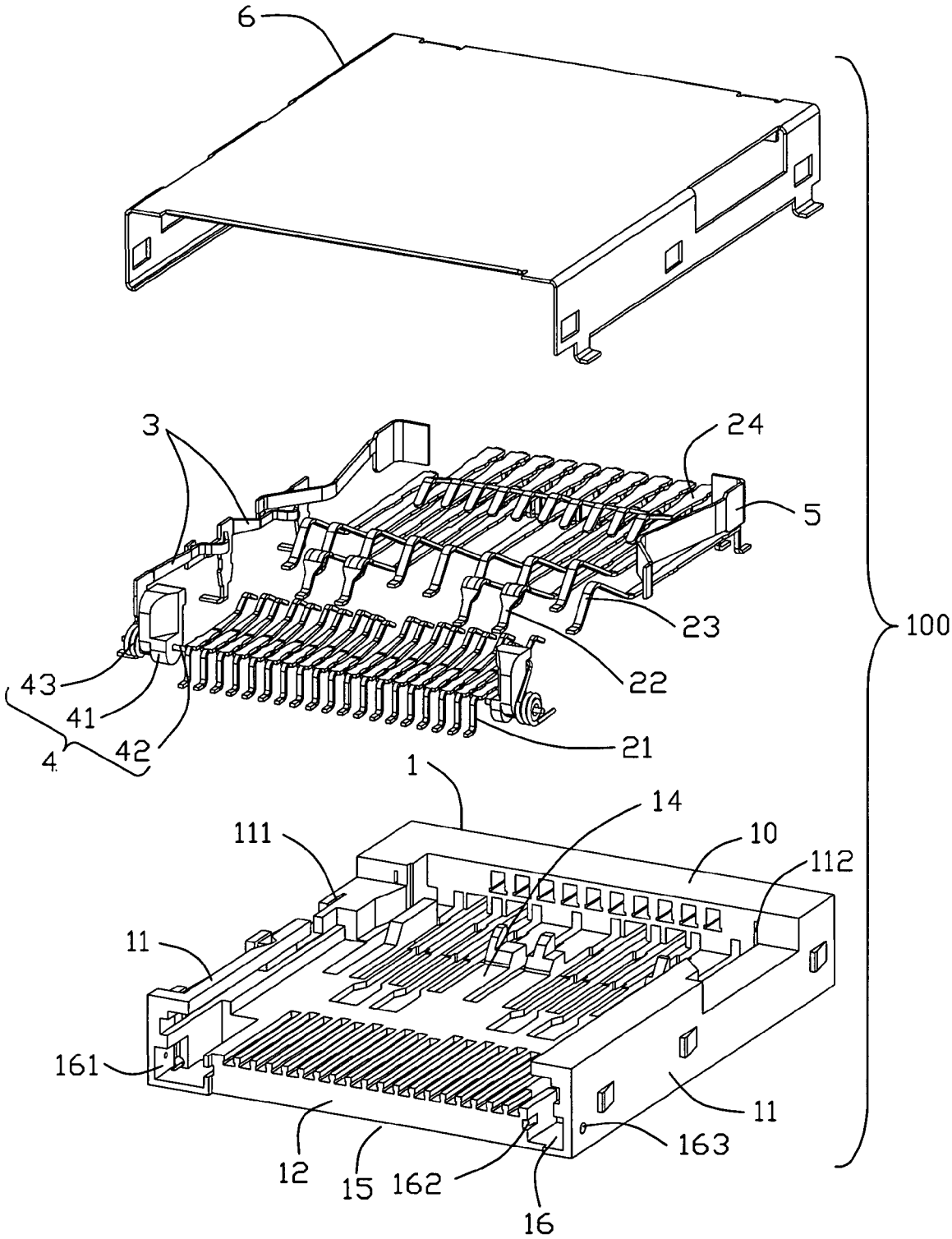
FIG. 4 is an exploded view of the electrical card connector.
Figure 5:
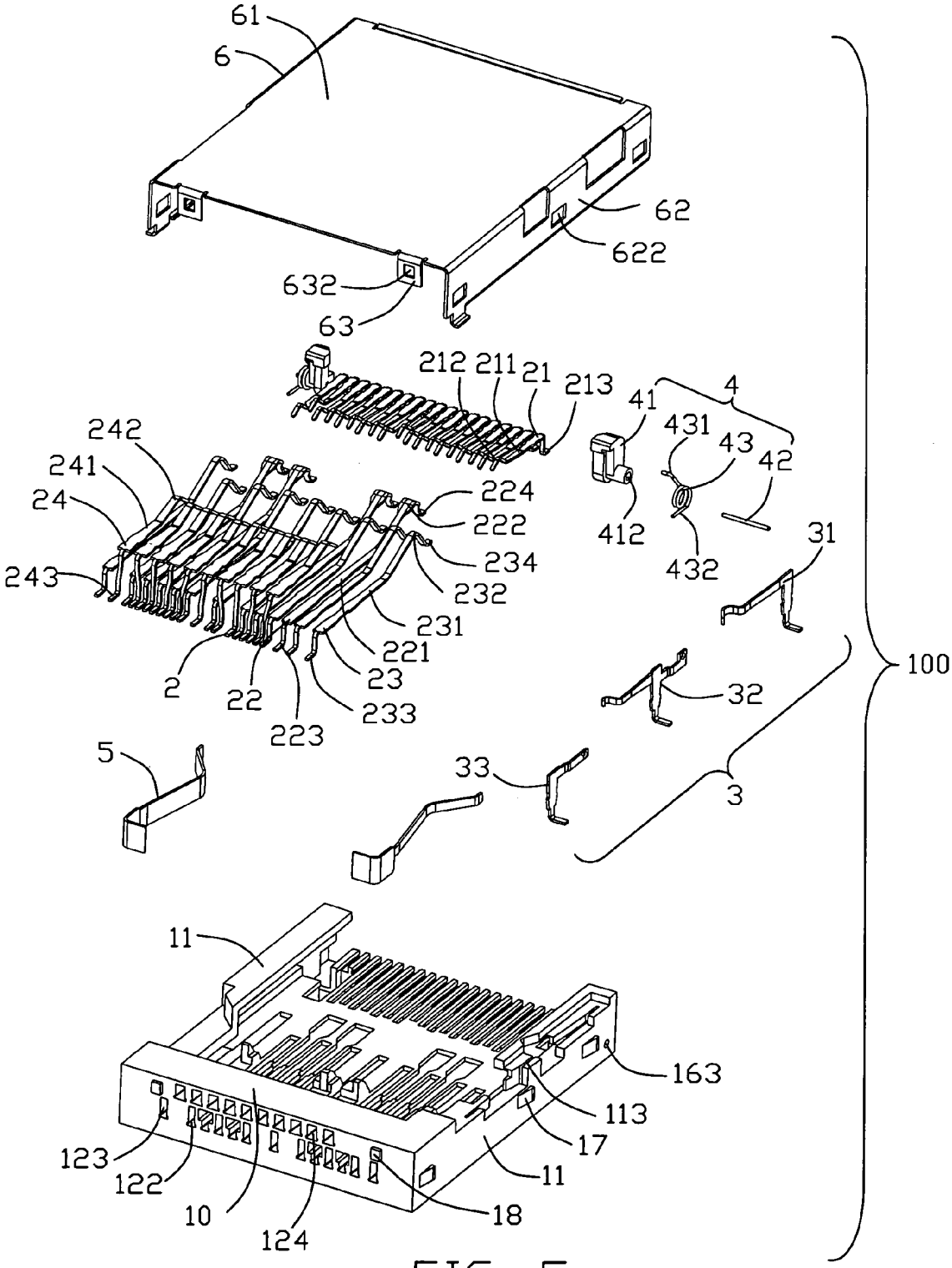
FIG. 5 is another exploded view of the electrical card connector.
Figure 6:
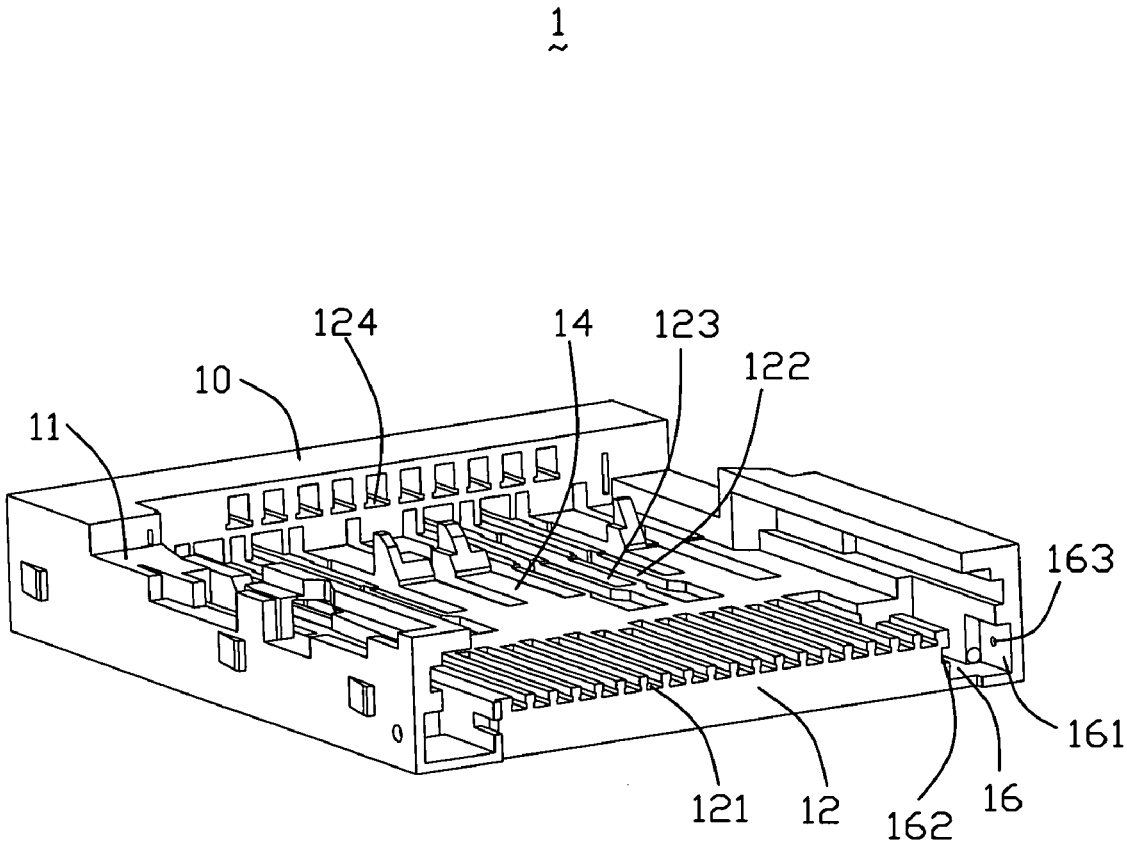
FIG. 6 is a perspective view of an insulative housing of the electrical card connector.
Figure 7:
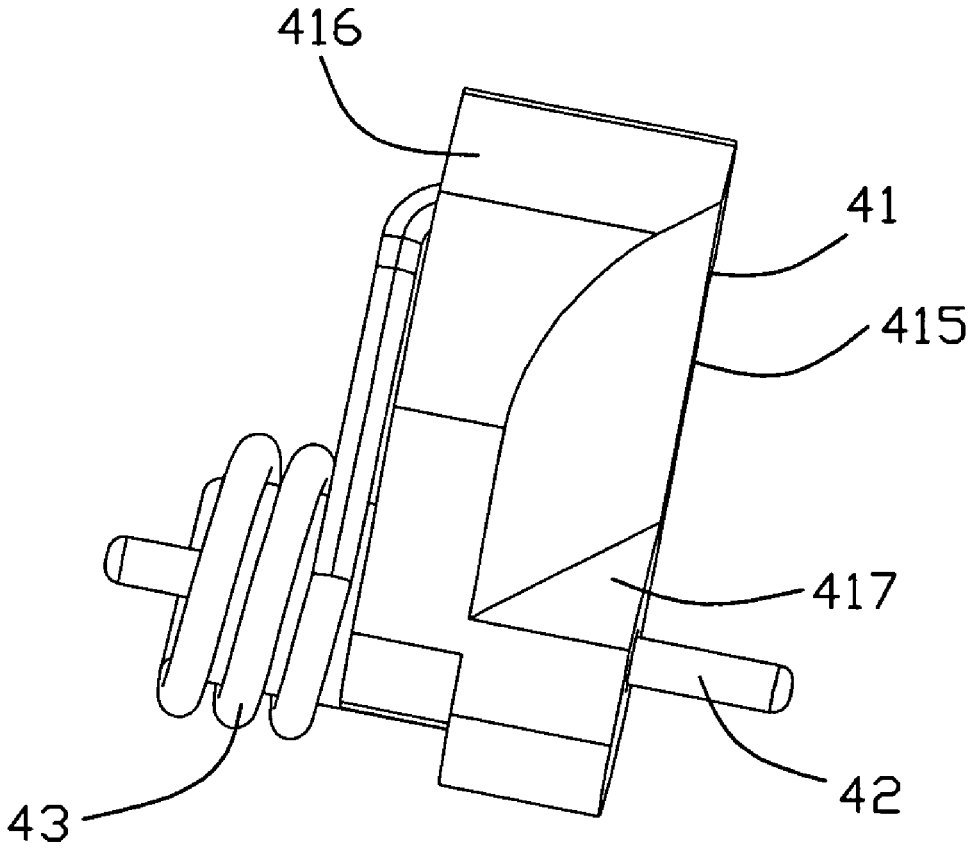
FIG. 7 is a perspective view of a card restriction mechanism of the electrical card connector.
Figure 8:
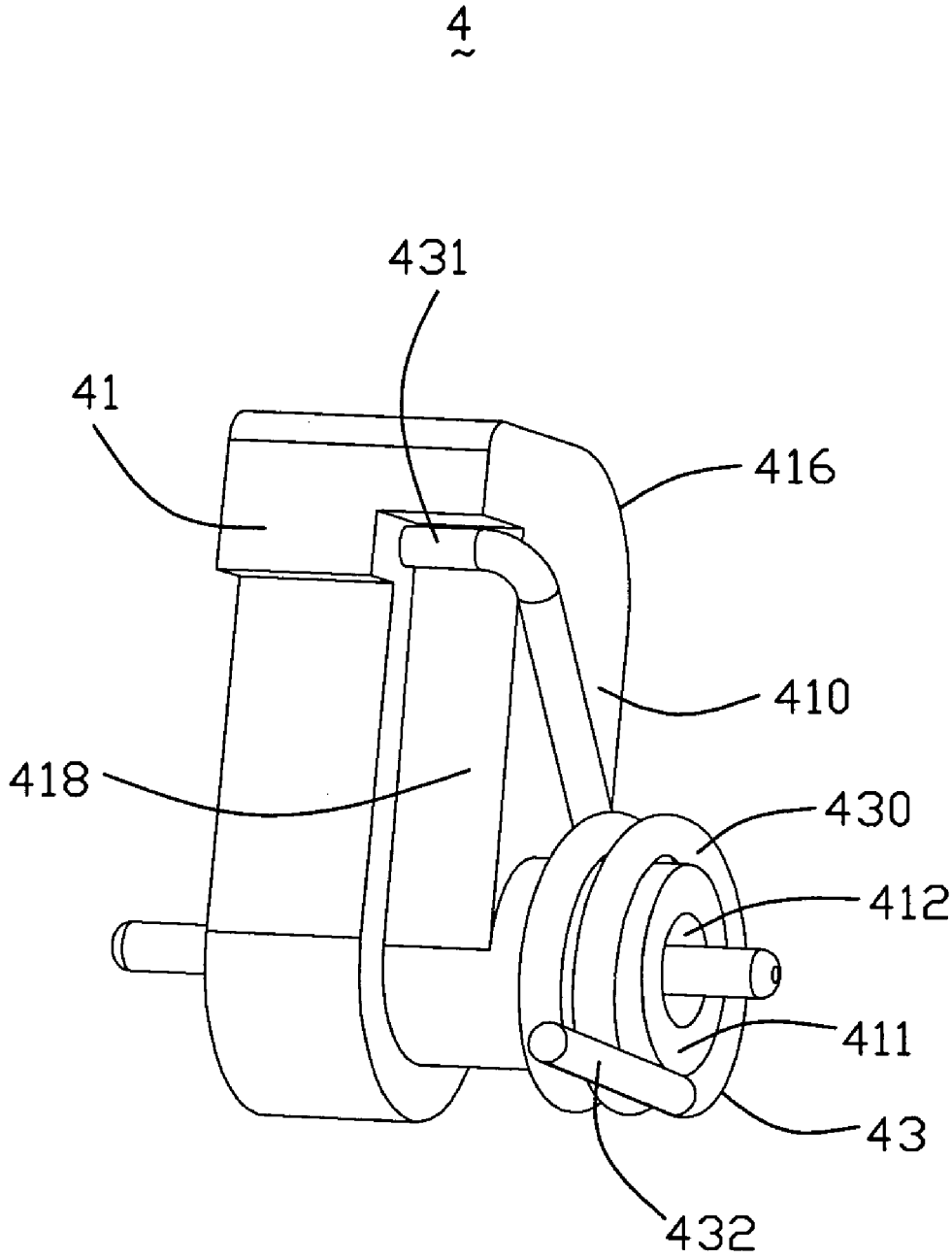
FIG. 8 is another perspective view of the card restriction mechanism of the electrical card connector.
Figure 9:
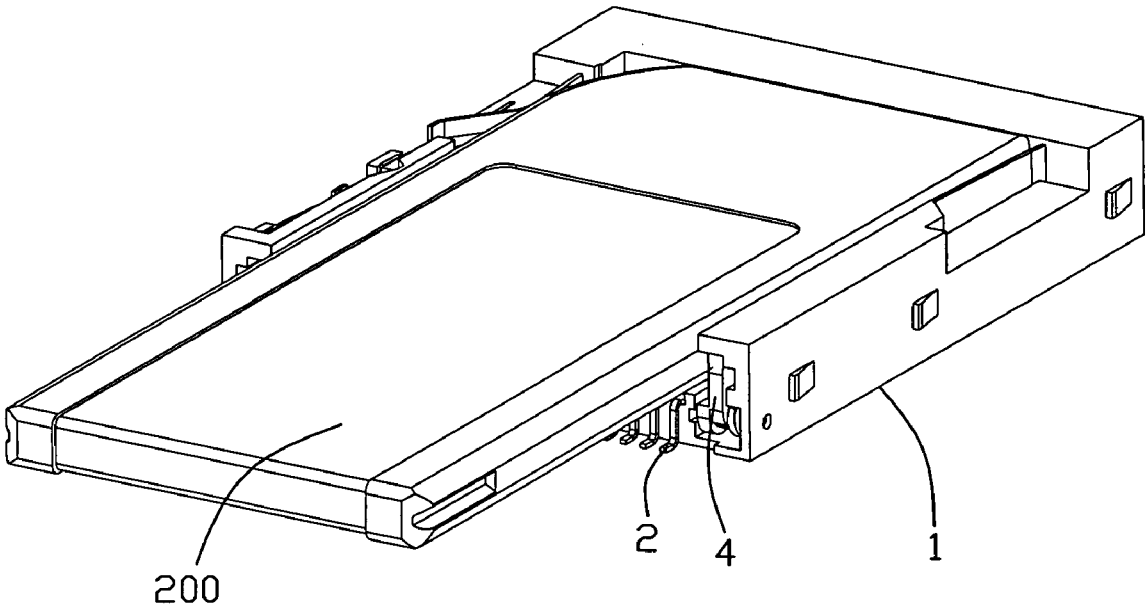
FIG. 9 is a perspective view of the electrical card connector after full insertion of a first card.
Figure 10:
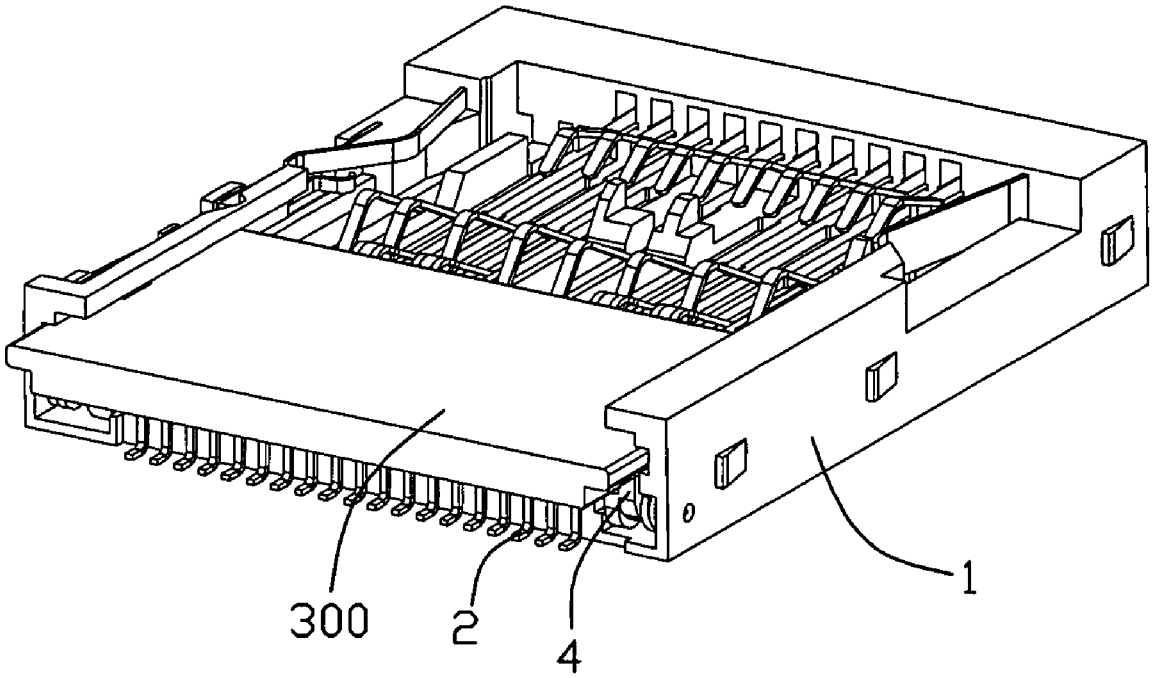
FIG. 10 is a perspective view of the electrical card connector after full insertion of a second card.

Referring to FIGS. 1-10, an electrical card connector 100 for being mounted on a PCB (not shown) can be used for insertion of many kinds of cards such a first card 200 and a second card 300 which is wider than the first card 200. In the preferred embodiment, the first card 200 is a MS card, and the second card 300 is a XD card. All the cards 200, 300 include flat contact pads (not shown) for electrically mating with the electrical card connector 100. The electrical card connector 100 includes an insulative housing 1, a plurality of terminals 2 for mating with the contact pads of the cards 200, 300, a switch terminal group 3, a pair of card restriction mechanisms 4 fixed to the insulative housing 1, a clip terminal 5, and a metal shell 3 covering the insulative housing 1.

The insulative housing 1 includes a base 10, a pair of side portions 11 extending forwardly from lateral sides of the base 10 and a bottom wall 12 connecting the base 10 and the side portions 11 therebetween. The insulative housing 1 defines a front mating port 15 and a card receiving space 14 recessed from the mating port 15. The receiving space 14 is located between the pair of side portions 11 and includes a first receiving space 141 for receiving the first card 200 and a second receiving space 142 disposed under the first receiving space 141 and being for receiving the second card 300. The first receiving space 141 is higher, longer but narrower than the second receiving space 142. The first receiving space 141 and the second receiving space 142 overlap partly with each in a vertical direction of the insulative housing 1.

The bottom wall 12 defines a plurality of first passages 121, second passages 122, third passages 123 and fourth passages 124 positioned along a rear-to-front direction in turn for receiving the terminals 2. The insulative housing 1 defines a front mating surface and two accommodating spaces 16 recessed rearwardly from the mating surface and disposed in a front end thereof for receiving the card restriction mechanisms 4. The accommodating spaces 16 is located adjacent to the side portions 11 and at an outside of the first receiving space 141 respectively. Each accommodating space 16 also extends into both of the second receiving space 142 and the mating port 15. The insulative housing 1 defines a first and second slots 161, 162 located at a front end of each accommodating spaces 16 and extending out of the insulative housing 1. Each side portions 11 defines a pivot hole 163 for fixing the card restriction mechanism 4 respectively. The pivot hole 163 extends through the side portions 12 into the first slot 161. The second slots 162 are positioned opposite to the pivot hole 163 with same height. The side portions 11 also define a plurality of fixing slots 111, 112 for securing the switch terminal group 3 and the clip terminal 5, and a plurality of positioning protrusions 17 for securing the shell 6 respectively. The base 10 defines a plurality of ribs 18 at a rear end thereof and a plurality of mounting posts 103 extending beyond a bottom portion thereof for mounting the electrical card connector to a PCB.

The terminals 2 are divided into a first terminal group 21, a second terminal group 22, a third terminal group 23 and a fourth terminal group 24. Each terminals 2 includes a engaging portion 211, 221, 231, 241 received into the passages 121, 122, 123, 124 of the insulative housing 1, a contact portion 212, 222, 232, 242 cantileveredly extending from one end of the engaging portion 211, 221, 231, 241 into the receiving space 14 and a soldering tail 213, 223, 233, 243 extending from another end of the engaging portion 211, 221, 231, 241. The contact portions 212, 222, 232, 242 is arranged in three rows along an inserting direction of the cards 200, 300. The soldering tails 213 of the first terminal group 21 extend out of the insulative housing 1 forwardly to be arranged in one row. The soldering tails 223, 233, 243 of the second terminal group 22, the third terminal group 23 and the fourth terminal group 24 extend backwardly out of the insulative housing 1 to arranged in one row.

The switch terminal group 3 includes a first switch terminal 31, a second switch terminal 32 and a third switch terminal 33 jointly for detecting insertion of the cards 200, 300. The switch terminal group 3 is widely used in electrical card connector, so detailed description is omitted hereinafter.

Each card restriction mechanisms 4 includes a guiding body 41, a metal shaft 42 and a elastic spring 43 located on the guiding body 41. The guiding body 41 includes a main portion 410, a protruding portion 411 protruding outwardly and laterally from the main portion 410, and a through hole 412 extending through the main portion 410 and the protruding portion 411 for receiving the shaft 42. The main portion 410 defines a first front guiding surface 413 at a front side thereof, a second curved guiding surface 414 curved backwardly from an inner edge of the first guiding surface 413, and a holding surface 415 disposed behind the second guiding surface 414 and formed on an inner side wall thereof. Both of the first guiding surface 413 and the holding surface 415 are vertical. The first guiding surface 413 and the second surface 414 face the mating port 15 for restricting and guiding the first and the second cards 200, 300 therein. The main portion 410 further defines an arc portion 416 on an upper side thereof for guiding the cards 200, 300, a level support surface 417 on a level side thereof to connect the guiding surface 413 and the second guiding surface 414, and a recess 418 disposed on a rear end thereof. The elastic spring 43 includes a coiled portion 430 ringed on the protruding portion 411 and a pair of first and second flexible abutting portions 431, 432 extending from opposite ends of the coiled portion 430. The first abutting portion 431 is fixed on the recess 418 to abut against the main portion 410 towards the mating port 15.

The metal shell 6 includes a rectangular top wall 61 defining a top side of the receiving space 14, a pair of side walls 62 extending downwardly from lateral sides of the top wall 61, and two locating plates 63 extending downwardly from a rear end of the top wall 61. Each side walls 61 defines a plurality of positioning holes 622 for receiving the positioning protrusions 17 of the insulative housing 1 so that the shell 3 can be firmly attached to the side portions 11 of the insulative housing 1. Each locating plates 63 defines a locking hole 632 for retaining the ribs 18 of the insulative housing 1.

In assembly, the terminals 2, the switch terminal group 3 and the clip terminal 5 is received into the insulative housing 1 and extending into the receiving space 14 for engaging with the cards 200, 300. The pair of the card restriction mechanisms 4 are fixed into the accommodating spaces 16 respectively. Two opposite ends of the shaft 42 are pivotably received into the pivot hole 163 of the side portions 11 and the second slot 162 respectively so that the guiding body 41 can rotate on the insulative housing 1. The second abutting portion 432 of the elastic spring 43 is pressing on a bottom side of the insulative housing 1. The guiding body 41 rotates upwardly by the elastic spring 43 when the second card 300 is retracted from the receiving space 14. The first receiving space 141 is disposed between the pair of restricting mechanisms 4. The support surface 417 of the guiding body 41 and a bottom surface of the first receiving space 141 are located in a level surface.

While the first card 200 is being inserted into first receiving space 141 through the mating port 15, the first card 200 is restricted and guided in the level direction by the second guiding surface 414 and supported by the support surface 417 in the vertical direction. So that the first card 200 can be inserted into the first receiving space 141 smoothly. The holding surfaces 415 of the pair of guiding bodies 41 sandwich two opposite side edges of the first card 200 for regulating the pads of the first card 200 to contact corresponding terminals 2.

While the second card 300 is being inserted into the second receiving space 142 through the mating port 15, the second card 300 would be restricted and guided in the vertical direction by the first guiding surface 413. At the same time, the guiding bodies 41 is rotating along the shaft 42 downwardly, the second card 300 moving along the arc portion 416 into the second receiving space 142 from the mating port 14 smoothly. The arc portion 416 could decrease inserting force of the second card 300.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed. For example, the tongue portion is extended in its length or is arranged on a reverse side thereof opposite to the supporting side with other contacts but still holding the contacts with an arrangement indicated by the broad general meaning of the terms in which the appended claims are expressed.

We claim:

1. An electrical card connector for insertion of a first card and a second card which is wider than the first card, comprising:

an insulative housing defining a front mating port and a card receiving space extending rearwardly from the mating port for receiving the first and the second cards respectively, the insulative housing including a base and a pair of side portions extending forwardly from lateral sides of the base, the receiving space disposed between the side portions;

a plurality of terminals with contact portions extending into the receiving space for mating with the first and the second cards and soldering tails extending out of the insulative housing; and a pair of card restriction mechanisms fixed to the insulative housing and located adjacent to the pair of side portions respectively and extending into the receiving space, each of the card restriction mechanisms comprising: a guiding body extending into the receiving space and an elastic spring located on the guiding body for abutting against the guiding body towards the mating port in order to restrict and guide the first and the second cards directly in the mating port;

wherein the guiding body defines a first guiding surface and a second guiding surface both of which facing the front mating port, the first guiding surface is for restricting and guiding the second card in a vertical direction, the second guiding surface is for restricting and guiding the first card in a level direction;

wherein the each card restriction mechanism includes a shaft pivoted on the insulative housing, the guiding body includes a main portion, a protruding portion protruding from the main portion, and a through hole extending through the main portion and the protruding portion for receiving the shaft; and wherein the elastic spring includes a coiled portion ringed on the protruding portion and a pair of first and second abutting portions extending from opposite ends of the coiled portion, the first abutting portion is fixed on a recess of the guiding body, and the second abutting portion press on a bottom side of the insulative housing.

2. The electrical card connector as claimed in claim 1, wherein the second guiding surface extends backwardly from an inner edge of the first guiding surface.

3. The electrical card connector as claimed in claim 1, wherein card receiving space includes a first receiving space for receiving the first card and a second receiving space for receiving the second card, the first receiving space is narrower than the second receiving space, the first receiving space and the second receiving space overlap partly with each other in the vertical direction.

4. The electrical card connector as claimed in claim 1, wherein the guiding body defines a holding surface disposed on an inner side wall thereof for sandwiching an outer side of the second card, the holding surface is located behind the first and the second guiding surfaces.

5. The electrical card connector as claimed in claim 1, wherein the guiding body defines a lever support surface on a level side thereof to connect the guiding surface and the second guiding surface, the support surface defined for supporting the first card and is located behind the first guiding surface, the support surface and a bottom surface of the first receiving space are located in a level surface.

6. The electrical card connector as claimed in claim 3, wherein the insulative housing defines a accommodating space for receiving the card restriction mechanism, the accommodating space is located adjacent to the side portions and on an outside of the first receiving space.

7. The electrical card connector as claimed in claim 1, wherein the terminals includes four groups of terminals, the soldering portions of one group of the terminals extend out of the insulative housing forwardly and arrange in one row, the rest of the soldering portions extend out of the insulative housing backwardly to be arranged in one row.

8. The electrical card connector as claimed in claim 1, further comprising a metal shell covering the insulating housing and including a top wall defining a top side of the card receiving space, a pair of side walls extending downwardly from lateral sides of the top wall, and some locating plates extending downwardly from a rear end of the top wall, each the side walls defines a plurality of positioning holes for retaining positioning protrusions of the side portions, and each the locating plates defines a locking hole for receiving a rib of the base.

9. An electrical card connector for insertion of a first card and a second card which is wider than the first card, comprising:

an insulative housing including a front mating port, a base and a pair of side portions extending from lateral sides of the base, a receiving space disposed between the pair of side portions and includes a first receiving space for receiving a first card and a second receiving space for receiving the second card, the second receiving space being wider than the first receiving space;

a plurality of terminals with contact portions extending into the receiving space for mating with the first and the second cards respectively and soldering tails extending out of the insulative housing; and a pair of card restriction mechanisms located adjacent to the pair of side portions respectively, comprising: a guiding body for restricting and guiding the first and second cards, and an elastic spring located on the guiding body for abutting against the guiding body moving;

wherein the insulative housing defines a front mating surface and a accommodating space recessed rearwardly from the mating surface for receiving the pair of card restriction mechanisms, the accommodating spaces located at a outside of the first receiving space and under the second receiving space, the guiding body extending upwardly into the second receiving space;

wherein the guiding body defines a first guiding surface and a second guiding surface both of which facing the front mating port, the first guiding surface is for restricting and guiding the second card in a vertical direction, the second guiding surface is for restricting and guiding the first card in a level direction;

wherein each of the card restriction mechanisms includes a shaft pivoted on the insulative housing, the guiding body includes a main portion, a protruding portion protruding from the main portion, and a through hole extending through the main portion and the protruding portion for receiving the shaft; and wherein the elastic spring includes a coiled portion ringed on the protruding portion and a pair of first and second abutting portions extending from opposite ends of the coiled portion, the first abutting portion is fixed on a recess of the guiding body, and the second abutting portion press on a bottom side of the insulative housing.

* * * * *